United States Patent [19]

Habib, Jr. et al.

[11] 4,312,840

[45] Jan. 26, 1982

[54] PROCESS FOR THE IN-SITU LEACHING OF URANIUM

[75] Inventors: Edward T. Habib, Jr., Richardson; Thomas C. Vogt, Jr., Duncanville, both of Tex.

[73] Assignee: Mobil Oil Corporation, New York, N.Y.

[21] Appl. No.: 928,676

[22] Filed: Jul. 28, 1978

[51] Int. Cl.[3] ..... C01G 43/00; E21B 43/28

[52] U.S. Cl. ..... 423/17; 299/4; 299/5

[58] Field of Search ..... 423/15, 17; 299/4, 5

[56] References Cited

U.S. PATENT DOCUMENTS

| | | | |
|---|---|---|---|
| 2,725,106 | 11/1955 | Spearow | 166/268 |
| 2,896,930 | 7/1959 | Menke | 299/5 |
| 2,954,218 | 9/1960 | Dew et al. | 299/4 |
| 3,098,707 | 7/1963 | Lewis | 423/17 |
| 3,647,261 | 3/1972 | Stenger et al. | 299/4 |
| 3,708,206 | 1/1973 | Hard et al. | 299/5 |
| 3,819,231 | 6/1974 | Fehlner | 299/4 |
| 4,071,278 | 1/1978 | Carpenter et al. | 299/4 |
| 4,105,253 | 8/1978 | Showalter | 423/17 |

OTHER PUBLICATIONS

Merritt, R. C., *The Extractive Metallurgy of Uranium*, Colorado School of Mines, Research Institute (1971) pp. 63, 104 and 105.

*Primary Examiner*—Deborah L. Kyle

*Attorney, Agent, or Firm*—Charles A. Huggett; Michael G. Gilman; James F. Powers, Jr.

[57] ABSTRACT

Process for the in-situ leaching of uranium employing an alkaline lixiviant and an alkali metal or alkaline earth metal hypochlorite as an oxidizing agent. The use of the hypochlorite oxidant results in significantly higher uranium recoveries and leaching rates than those attained by the use of conventional oxidants. The invention is particularly suitable for use in subterranean deposits in which the uranium mineral is associated with carbonaceous material which retards access to the uranium by the lixiviant.

7 Claims, 4 Drawing Figures

PROCESS FOR THE IN-SITU LEACHING OF URANIUM

BACKGROUND OF THE INVENTION

The present invention relates to the recovery of uranium from subterranean ore deposits and more particularly to an in-situ leaching employing an alkaline lixiviant with a hypochlorite oxidizing agent.

The various techniques for the production of uranium ore deposits may be characterized as falling within two general classes. One involves a surface milling operation in which uranium ore obtained by mining is crushed and blended and then subjected to a leaching procedure in which an acid or alkaline lixiviant is employed to extract uranium from the milled ore. The uranium is then recovered from the pregnant lixiviant by a suitable technique such as solvent extraction, direct precipitation, or by adsorption and elution employing an ion exchange resin. The other involves in-situ leaching in which a lixiviant is introduced into a subterranean ore deposit through a suitable injection system. The lixiviant may be an acidic or alkaline medium which solubilizes uranium values as it traverses the ore body. The pregnant lixiviant is then withdrawn from the ore body through a production system and treated to recover uranium therefrom by suitable techniques such as noted above. Mill leaching and in-situ leaching operations are similar in some respects and quite dissimilar in others. In both cases, the nature of the lixiviant is dictated to some extent by the nature of the uranium ore or the subterranean deposit. An acid lixiviant is used in most mill leaching operations since it is more effective with most ores and does not require that the ore be ground to as fine a state as in the case of an alkaline lixiviant. The use of acid lixiviant is somewhat limited in milled ores of high carbonate content which may lead to excessive consumption of acid. The presence of carbonate in subterranean rock deposits containing uranium also limits the use of acid lixiviants, not only with respect to acid consumption, but also due to the precipitation of reaction products, such as calcium sulfate which may result in plugging of the formation when sulfuric acid is used. Thus the use of an alkaline lixiviant is strongly indicated in many in-situ leaching operations, not only because of the carbonate content of the rock but also since alkaline lixiviants are more selective with respect to uranium dissolution than acid lixiviants.

In both milling and in-situ leaching operations, an oxidizing agent is employed in conjunction with the lixiviant in order to ensure that the uranium is oxidized to or retained in the hexavalent state at which it is solubilized by the acid or alkaline leach medium.

In milling operations employing an acid lixiviant, the oxidizing reaction requires the presence of iron and the principal oxidizing agents employed are manganese dioxide and sodium chlorate as disclosed in Merritt, Robert C., THE EXTRACTIVE METALLURGY OF URANIUM, Colorado School of Mines, Research Institute, U.S.A. (1971), p. 63. In an alkaline leach system, the tetravalent uranium is directly oxidized to the hexavalent state. As disclosed by Merritt, pages 104 and 105, the most widely used oxidant in milling operations employing an alkaline lixiviant is potassium permanganate. Other oxidizing agents disclosed by Merritt include sodium hypochlorite, hydrogen peroxide, potassium persulfate and copper sulfate.

In in-situ leaching operations employing an alkaline lixiviant, the most commonly employed oxidizing agents are hydrogen peroxide as disclosed in U.S. Pat. No. 2,896,930 to Menke and air as disclosed in U.S. Pat. No. 2,954,218 to Dew et al. A significant distinction between mill leaching and in-situ leaching resides in the fact that the latter procedure is carried out in a massive subsurface formation where the uranium mineral is present in small concentrations without the intimate contact between the lixiviant and ore found in milling operations where the ore is rubblized before leaching. Thus a rapid intrinsic leaching rate is more important in in-situ leaching than in leaching carried out after a milling operation. Also many of the so-called refractory ores are much more difficult to leach in an in-situ environment than in conjunction with a milling operation. For example, as noted in the aforementioned patent to Dew et al., some uranium ore bodies contain carbonaceous material which retards the leaching action of the lixiviant. While such ores can be leached after milling, leaching under in-situ conditions is extremely slow without special procedures such as the in-situ combustion procedure disclosed in the Dew et al. patent.

SUMMARY OF THE INVENTION

In accordance with the present invention, there is provided a new and improved process for the recovery of uranium from a subterranean deposit by employing an alkaline lixiviant and a hypochlorite oxidant. In carrying out the invention, there is introduced into the uranium-containing deposit via a suitable injection system an aqueous alkaline lixiviant having a pH of at least 7.5. The lixiviant contains an alkali metal or alkaline earth metal hypochlorite. As the lixiviant traverses the subterranean uranium deposit, the hypochlorite oxidant functions to oxidize uranium from the tetravalent to the hexavalent state at which the uranium is solubilized in the lixiviant. The pregnant lixiviant containing uranium is then produced from the deposit by a production system and treated to recover uranium therefrom.

In a further embodiment of the invention, uranium is recovered from the pregnant lixiviant through precipitation by reducing uranium from the hexavalent state to a water-insoluble tetravalent state. The pregnant lixiviant may be heated in order to carry out the reduction step at an elevated temperature. Subsequent to the precipitation of uranium, the heated barren lixiviant is then circulated to the injection system where it is employed to form fresh lixiviant which is introduced into the deposit in a heated state. A preferred application of the present invention is in refractory deposits which contain uranium associated with carbonaceous material.

DESCRIPTION OF SPECIFIC EMBODIMENTS

Figure 1:
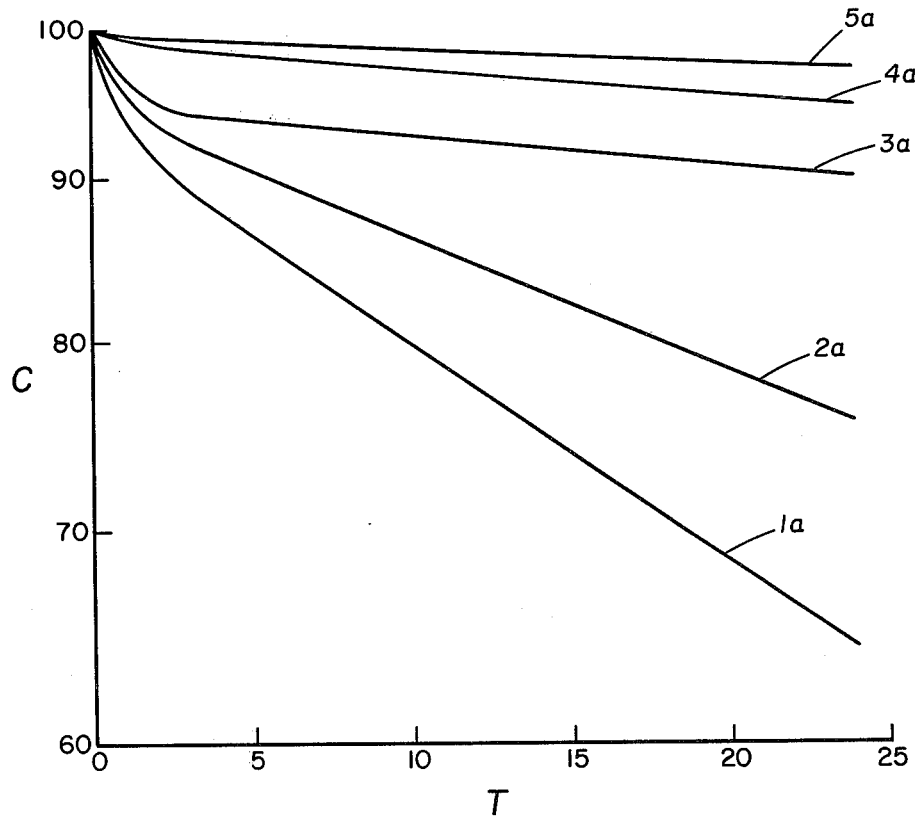
FIG. 1 is a graph illustrating the relationship between uranium recovery and time for batch leaching tests carried out for certain lixiviant systems.

This invention relates to an in-situ leaching process employing a hypochlorite oxidizing agent under certain conditions of pH and concentration. The hypochlorite is in the form of an alkali metal or alkaline earth metal salt and thus may take the form of sodium hypochlorite, potassium hypochlorite, calcium hypochlorite, or magnesium hypochlorite. Normally it will be desirable to employ sodium hypochlorite for reasons of economics and ease of preparation at the leaching site.

Sodium hypochlorite is a strong oxidizing agent and has been proposed for use in a chemical oxidation of uranium ores in carbonate leach milling operations. As disclosed in U.S. Pat. No. 3,647,261 to Stenger et al., it also has been proposed for use in the in-situ leaching of noble metals such as silver and gold which require extremely high oxidation potentials. However, the hypochlorites have not heretofore been used as oxidizing agents in in-situ leaching of uranium employing alkaline lixiviants. In this regard it will be noted that uranium, unlike the noble metals, is highly active and is readily oxidized from the tetravalent to the hexavalent state. Thus, while sodium hypochlorite is recognized in Merritt as a most economical oxidant, its use is attended with several disadvantages including the buildup of chlorides as byproducts of the leaching reaction. This high chloride content is inconsistent with the use of the anionic ion exchange resins as normally employed in extracting the uranium from the spent lixiviant. This coupled with the fact that sodium hypochlorite has appeared to be only moderately more effective than other oxidants such as hydrogen peroxide, dipotassium sulfate, and potassium permanganate has negated the use of hypochlorites in in-situ leaching operations. Stated otherwise, since uranium is highly active, the moderate increase in uranium recovery heretofore associated with the use of these extremely strong oxidants has been more than offset by the deleterious side effects associated with their use.

As indicated by the experimental data presented hereafter, the present invention employs an alkali metal or alkaline earth metal hypochlorite as an oxidant in in-situ alkaline leach operations under conditions at which a severalfold increase in uranium recovery is attained. For example, the percent of uranium extracted employing sodium hypochlorite in accordance with the present invention is several times that obtained while employing hydrogen peroxide. This may be contrasted with the increase of less than 20% in aboveground milling operations as noted, for example, in Table 5-9 of Merritt at page 105.

The efficacy of employing a hypochlorite oxidant in an alkaline lixiviant in accordance with the present invention is illustrated by comparative laboratory experiments employing different oxidants. Two general experimental procedures were followed. In one referred to herein as the "batch" technique, the experimental procedure involved the addition of 50 $cm^3$ of lixiviant to a container containing 10 grams of uranium ore. The container was then placed in a shaker where it was agitated at room temperatures. After 3 hours of agitation, the lixiviant was withdrawn and filtered and the filtrate then analyzed for uranium by the colorimetric method. For each test, this identical procedure was followed on a second sample of the same ore with the exception that the agitation continued for a period of 24 hours. The uranium leached from the ore sample at the end of the 3-hour and 24-hour periods was then employed to calculate a first order rate constant in accordance with the following equation:

$$K=(LnC_0-LnC_1)/t \quad (1)$$

wherein

K is the rate constant in $hours^{-1}$, $C_0$ is the uranium content of the ore sample after leaching for a first period, i.e. 3 hours, $C_1$ is the uranium content of the ore sample after leaching for a second period, i.e. 24 hours, and t is the elapsed time between the two leaching periods, i.e. 21 hours.

In the pack leaching procedure, the uranium ore was packed into a vertical plastic pipe having an internal diameter of $\frac{3}{4}$ inch and a length of 12 inches. The lixiviant was flowed downwardly through the pack and the pregnant lixiviant recovered from the bottom of the pack and analyzed daily for uranium by the colorimetric method.

In a first suite of experiments, batch leaching tests were conducted on a number of ore samples of a composite ore obtained from the same core hole penetrating a subterranean uranium deposit. The ore contains uranium in the form of coffinite occurring as individual grains and aggregates of grains in a matrix of carbonaceous material. The matrix contains other minerals such as pyrite, apatite, anatase or rutile and chlorite. The carbonaceous material occurs in a poorly sorted sandstone consisting of detrital quartz, feldspar and rock fragments. Locally abundant kaolinite or chlorite, calcite and the carbonaceous material are the primary cementing agents.

This suite of experiments was carried out employing a carbonate lixiviant and sodium hypochlorite, hydrogen peroxide, sodium chlorate, or potassium permanganate as the oxidant. The results of the experimental work are set forth in Table I in which the second column indicates the lixiviant composition in terms of the concentration of oxidant and sodium bicarbonate, the third column the pH of the lixiviant, and the fourth column the first order rate constant, K, times $10^3$ as calculated in accordance with equation (1). The oxidant and bicarbonate concentrations are set forth in weight percents. In describing the present invention and the supporting laboratory data, percents are calculated on a weight (solute)/volume (solution) basis. Thus, in test 1, for example, the 5% sodium hypochlorite solution contained 5 grams of sodium hypochlorite per deciliter of solution. The lixiviants employed in the batch test were formed by adding the oxidizing agent and sodium bicarbonate to distilled water and then adding hydrochloric acid in an amount as necessary to give the indicated pH. In run 6, the lixiviant solvent was formulated from equal parts of distilled water and acetone and in run 7 from equal parts of distilled water and methanol. As shown in the table, sodium bicarbonate was employed in all of the runs with the exception of test 9 where the carbonate lixiviant was formed by the addition of sodium carbonate and in run 11 by ammonium bicarbonate.

TABLE I

| Run No. | Lixiviant Composition | | pH | K |
|---|---|---|---|---|
| 1 | 5.0% NaOCl | .21% $NaHCO_3$ | 8.3–9.6 | 12–15 |
| 2 | 1.0% NaOCl | .21% $NaHCO_3$ | 8.3–9.3 | 10 |
| 3 | 0.5% NaOCl | .21% $NaHCO_3$ | 8.3 | 2.3 |
| 4 | 2.1% $H_2O_2$ | .21% $NaHCO_3$ | 8.3 | 2.3 |
| 5 | 0.21% $H_2O_2$ | .21% $NaHCO_3$ | 8.0–8.3 | 2.0 |
| 6 | 0.21% $H_2O_2$ | .21% $NaHCO_3$ | 8.3 | 1.3 |
| 7 | 0.21% $H_2O_2$ | .21% $NaHCO_3$ | 8.3 | <1 |
| 8 | 0.2% $NaClO_3$ | .21% $NaHCO_3$ | 8.3 | <1 |
| 9 | 0.21% $H_2O_2$ | .25% $Na_2CO_3$ | 11.3–12.0 | <1 |

TABLE I-continued

| Run No. | Lixiviant Composition | | pH | K |
|---|---|---|---|---|
| 10 | 0.5% $KMnO_4$ | .21% $NaHCO_3$ | 8.3 | <1 |
| 11 | 2.1% $H_2O_2$ | Sat. $NH_4HCO_3$ | 8.3 | <1 |

From an examination of the data set forth in Table I, it can be seen that sodium hypochlorite was capable of producing a much higher leaching rate than the hydrogen peroxide, the next most effective oxidant. The other oxidants tested, sodium chlorate and potassium permanganate, resulted in K-values of less than $1\times10^{-3}$ hours$^{-1}$.

Turning now to the drawings, FIG. 1 is a graphical presentation of the leaching rates observed for runs 1 through 4 of Table I. In FIG. 1, curves 1*a*, 2*a*, 3*a*, and 4*a* are graphs of the log of uranium concentration of the ore, C expressed as a percentage of the original uranium concentration in the ore plotted on the ordinate versus the leaching time in hours plotted on the abscissa for runs 1, 2, 3, and 4, respectively. Curve 5*a* is a similar plot for two batch leaching tests employing acid lixiviants. In one case, the lixiviant contained sufficient sulfuric acid to provide a pH of 2 and in the other case hydrochloric acid to provide the same pH. The oxidant employed in each of these cases was hydrogen peroxide in a concentration of 0.21 weight percent. In reviewing the data presented in FIG. 1 and also in Table I, it will be noted that the stoichiometric weight ratio of sodium hypochlorite to hydrogen peroxide is about 2.2. Or, stated otherwise, about 1 gram of hydrogen peroxide is stoichiometrically equivalent to about 2.2 grams of sodium hypochlorite in the oxidation of uranium from the tetravalent to the hexavalent state. Thus the amount of hydrogen peroxide employed in the test corresponding to curve 4*a* was significantly greater than the sodium hypochlorite employed in the test associated with curves 2*a* and 3*a* and only slightly less than that for the test associated with curve 1*a*.

In further experimental work, a pack leaching test was carried out employing the equipment and format described previously. In this test, the packed column was first preflushed with 5.4 pore volume of an alkaline lixiviant containing 0.1% sodium bicarbonate and 0.3% sodium chloride. The preflush lixiviant, which did not contain an oxidizing agent, was injected at a rate of about 1.8 pore volumes per day. During this preflush, less than 1% of the uranium originally present in the sample was recovered. Thereafter, an alkaline lixiviant containing a hypochlorite oxidant in accordance with the present invention was injected into the column. This lixiviant contained 1.0 weight percent sodium hypochlorite, 0.4 weight percent sodium bicarbonate, and 0.8 weight percent sodium chloride. The lixiviant was introduced into the pack in a sequence which provided for injection for a period of 1 hour followed by a 2-hour off period to provide an average injection rate of 0.6 pore volume per day.

Figure 2:
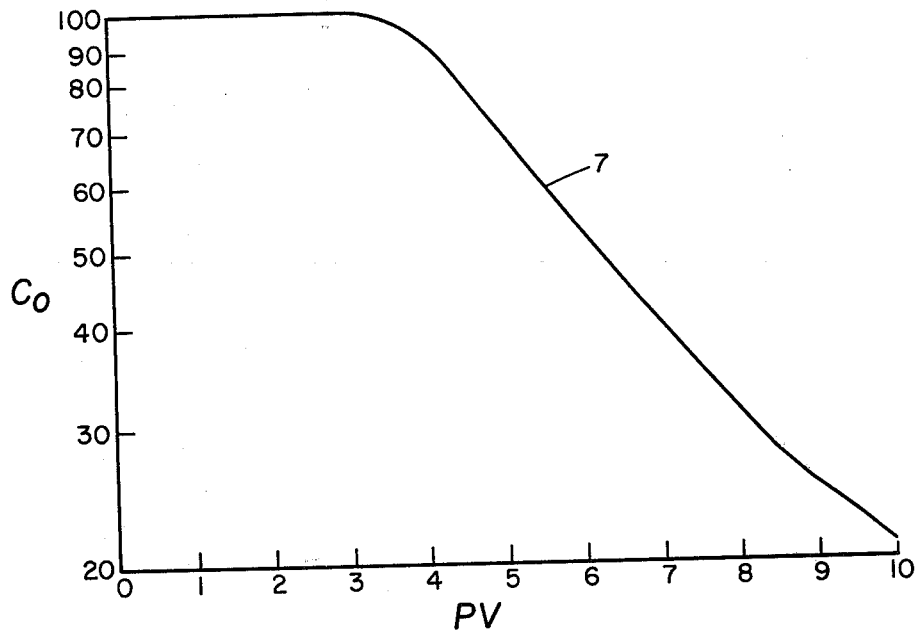
FIGS. 2 and 3 are graphs illustrating the relationship between uranium recovery and pore volumes of lixiviant employed in a packed column leaching test carried out employing a lixiviant useful in the present invention.
Figure 3:
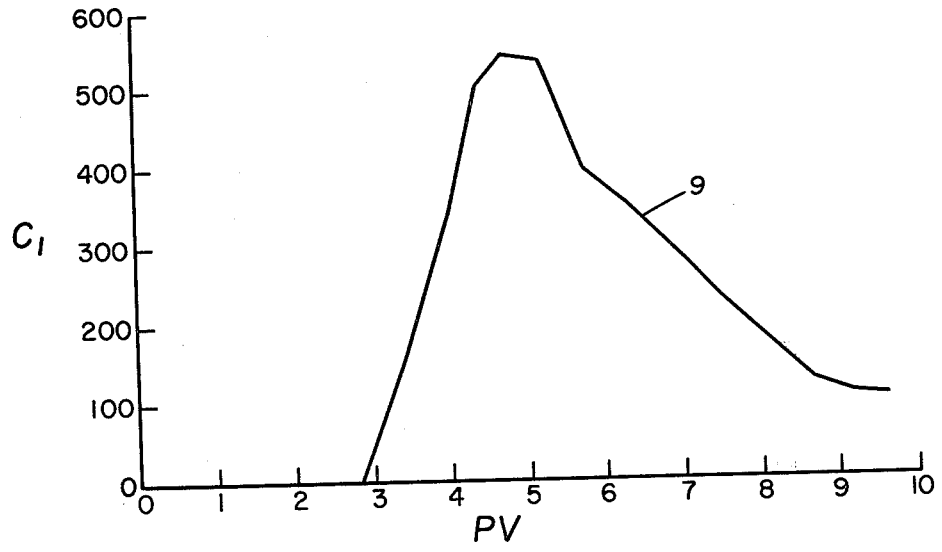

The results of the pack run are illustrated in FIGS. 2 and 3. In FIG. 2, curve 7 is a graph of the log of the uranium concentration, $C_0$, remaining in the ore expressed as a percent of the original uranium content plotted on the ordinate versus the amount of lixiviant injected in pore volumes on the abscissa. Curve 9 in FIG. 3 is a plot of the log of produced uranium concentration, $C_1$, in parts per million of $U_3O_8$ in the pregnant lixiviant on the ordinate versus the amount of lixiviant injected in pore volumes on the abscissa. From a review of FIGS. 2 and 3, it can be seen that nearly 80% of the uranium in the pack was recovered after the injection of 10 pore volumes of lixiviant. Further, it will be noted that good leaching action was obtained in the presence of the relatively high sodium chloride concentration. The results of the pack leaching experimental procedure are, of course, particularly significant since this technique more closely simulates the conditions encountered in in-situ leaching than does the batch leaching technique.

Table II sets forth the results of further experimental work carried out with carbonate lixiviants and presents a direct comparison of the efficacy of hydrogen peroxide and sodium hypochlorite on a wide variety of ore samples. Two standard lixiviant solutions were employed. The first contained 0.46 weight percent hydrogen peroxide and 0.21 weight percent sodium bicarbonate and the second contained 1.0 weight percent sodium hypochlorite and 0.21 weight percent sodium bicarbonate. In each case, the pH of the lixiviant was 8.5. It will be noted that the amounts of oxidant in the two lixiviants were stoichiometrically equivalent since the hydrogen peroxide and the sodium hypochlorite were employed in the same molar concentrations. In Table II, the first column identifies the test number with the same numerical designation employed to identify samples obtained from a common core hole but at different depths. Thus, tests 12*a*, 12*b*, and 12*c*, for example, were run employing ore samples obtained from different depths of the same well. Tests 14, 15, 16, and 17 were carried out on samples obtained from the same coffinite deposit as described previously. The other samples employed in the tests were obtained from other subterranean deposits within several miles of each other in which the uranium was in the form of cofffinite associated with carbonaceous material as described previously.

Column 2, of Table II, gives the original uranium content of the samples expressed as weight percent of $U_3O_8$ and the third and fourth columns give the rate constants calculated in accordance with equation (1) for the lixiviants containing hydrogen peroxide and sodium hypochlorite, respectively. The last column sets forth the ratio obtained by dividing the rate constant for the hypochlorite lixiviant by the rate constant of the hydrogen peroxide lixiviant. As illustrated by the data presented in Table II, the leaching rates for the lixiviant employing sodium hypochlorite were much greater than for the lixiviant employing hydrogen peroxide. In every case, the leaching rate for the hypochlorite lixiviant was greater than the leaching rate for the hydrogen peroxide lixiviant by a factor of 2 of more.

TABLE II

| Run No. | % $U_3O_8$ | Rate Constants ($hr^{-1}\times10^3$) K($H_2O_2$) | K(NaOCl) | Ratio K(NaOCl)/K($H_2O_2$) |
|---|---|---|---|---|
| 12A | 0.046 | 1.9 | 9.1 | 5 |
| 12B | 0.017 | 1.6 | 3.3 | 2 |
| 12C | 0.108 | 0.9 | 8.2 | 9 |
| 13 | 0.041 | 1.4 | 5.4 | 4 |
| 14 | 0.047 | 1.3 | 3.4 | 2 |
| 15 | 0.029 | 2.9 | 24.7 | 8 |
| 16A | 0.027 | 2.4 | 6.8 | 3 |
| 16B | 0.061 | 1.8 | 15.1 | 9 |
| 16C | 0.054 | 1.2 | 10.1 | 9 |
| 16D | 0.143 | 1.3 | 34.8 | 26 |
| 16E | 0.147 | 2.1 | 32.1 | 15 |
| 17A | 0.071 | 1.1 | 15.0 | 13 |
| 17B | 0.242 | 1.3 | 24.2 | 18 |
| 17C | 0.030 | 0.9 | 5.8 | 7 |

TABLE II-continued

| Run No. | % $U_3O_8$ | Rate Constants ($hr^{-1} \times 10^3$) K($H_2O_2$) | K(NaOCl) | Ratio K(NaOCl) / K($H_2O_2$) |
|---|---|---|---|---|
| 17D | 0.046 | 1.3 | 3.3 | 3 |
| 17E | 0.026 | 1.2 | 4.8 | 4 |
| 18 | 0.142 | 1.1 | 11.3 | 10 |
| 19 | 0.296 | 2.5 | 15.1 | 6 |
| 20A | 0.087 | 1.6 | 8.0 | 5 |
| 20B | 0.047 | 1.4 | 4.2 | 3 |
| 21 | 0.150 | 8.4 | 37.3 | 4 |
| 22A | 0.030 | 0.9 | 1.9 | 2 |
| 22B | 0.260 | 0.3 | 1.9 | 7 |
| 23 | 0.205 | 2.7 | 26.2 | 10 |
| 24 | 0.187 | 1.0 | 11.4 | 11 |
| 25A | 0.067 | 0.7 | 6.8 | 9 |
| 25B | 0.150 | 1.1 | 9.5 | 8 |
| 26A | 0.026 | 1.2 | 2.0 | 2 |
| 26B | 0.153 | 3.0 | 16.8 | 6 |
| 27 | 0.042 | 2.2 | 12.2 | 6 |
| 28 | 0.082 | 2.0 | 14.9 | 8 |

The average leaching rate for all of the samples tested was eight times faster with the hypochlorite than with the peroxide. The greatest improvement was observed for ore samples having an original uranium content of at least 0.1 weight percent $U_3O_8$. In this case, the lixiviant employing the hypochlorite averaged eleven times faster than the lixiviant employing the hydrogen peroxide.

Alkaline lixiviants normally employ carbonate ions added as alkali metal carbonates or bicarbonates or mixtures thereof to complex the uranium in the form of the water-soluble uranyl tricarbonate ion and the present invention may be carried out employing the hypochlorite oxidant and an otherwise standard carbonate lixiviant. The hypochlorite oxidant may be employed in any suitable concentration, but usually will be present in a concentration of at least 0.01 weight percent. Preferably the hypochlorite concentration of the lixiviant is within the range of about 0.1–1.0 weight percent. While concentrations greater than 1.0 weight percent may be employed, this usually should be avoided since the attendant higher leaching rates are more than offset by the increased chemical costs. As noted previously, the pH of the lixiviant is at least 7.5 to avoid decomposition of the hypochlorite. Preferably, the pH of the lixiviant is within the range of 8.0–10.0 for the most effective solubilization of the tetravalent uranium.

A preferred application of the invention is in those deposits containing uranium associated with carbonaceous material as described previously. The carbonaceous material is present in intimate contact with the uranium mineral and retards access to the uranium by the lixiviant. The hypochlorite functions to not only oxidize the uranium to the hexavalent state, but also to disrupt the carbonaceous material so that the uranium is exposed to the solubilizing action of the lixiviant. In most cases, the carbonaceous material is present in the uranium deposit in an amount of at least 0.1 weight percent expressed as total organic carbon. The concentration may range up to about 2% total organic carbon.

The present invention may be carried out utilizing injection and production systems as defined by any suitable well arrangement. One well arrangement suitable for use in carrying out the invention is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically the spacing between injection and production wells will be on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

Figure 4:
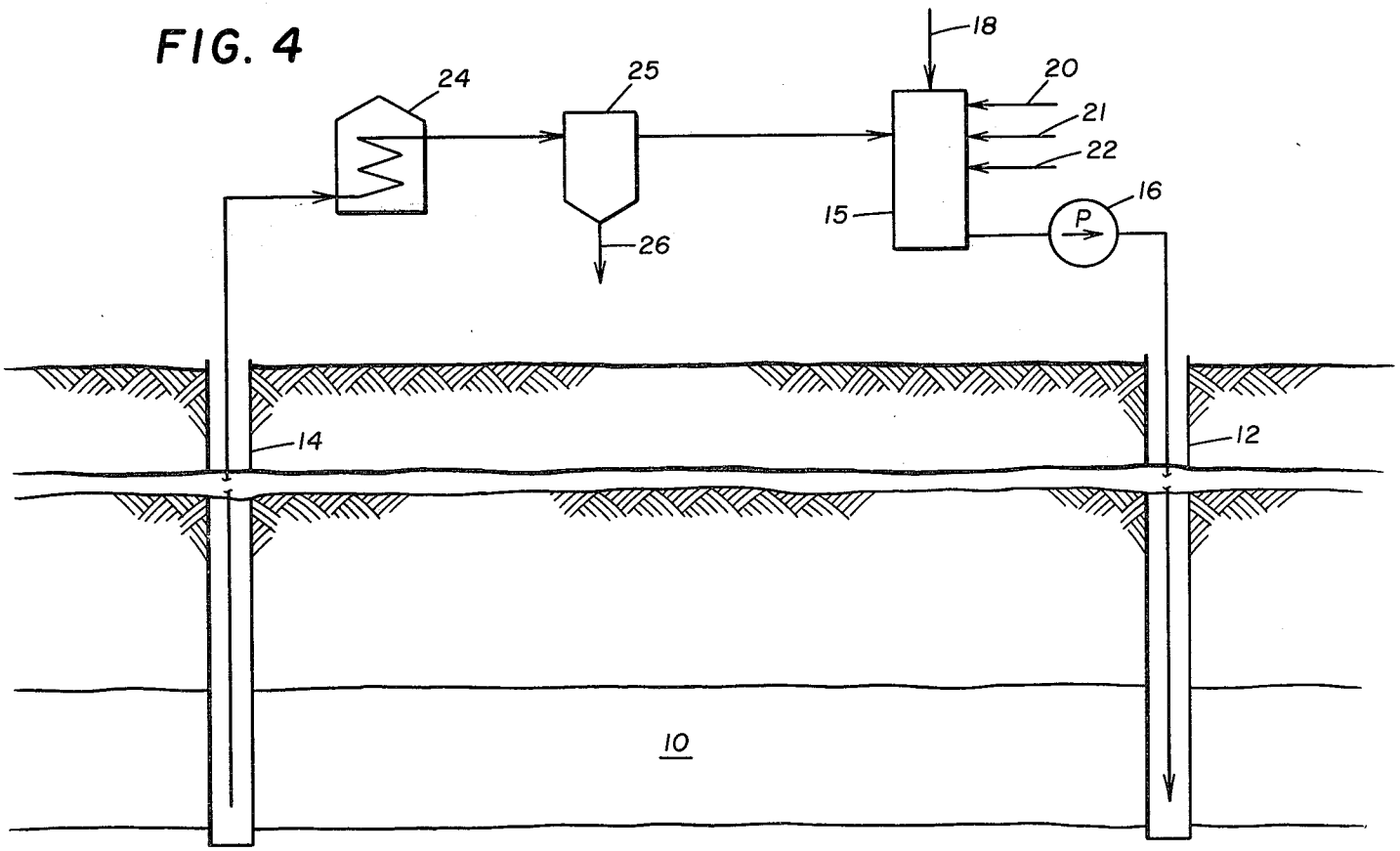
FIG. 4 is an illustration of an in-situ leaching circuit which may be employed in carrying out the present invention.

FIG. 4 is a schematic illustration of an in-situ leaching circuit which may be employed in carrying out the invention. In this circuit fresh alkaline lixiviant containing the appropriate amount of hypochlorite oxidant is introduced into the subterranean uranium body via the injection system. The hypochlorite preferably is incorporated into the lixiviant by adding stoichiometric amounts of elemental chlorine and the appropriate alkali metal or alkaline earth metal hydroxide which react to form the corresponding hypochlorite with sodium chloride as a byproduct. The lixiviant is displaced through a desired portion of the subterranean deposit to solubilize uranium values and the pregnant lixiviant is then withdrawn through the production system and treated at the surface to recover uranium therefrom. In the specific embodiment illustrated in FIG. 4, the uranium is recovered by a direct precipitation technique which involves reducing the uranium to a water-insoluble tetravalent state. After uranium is recovered, the barren lixiviant is then recirculated to the injection system where it is employed in formulating fresh lixiviant. The fresh lixiviant is then recirculated into the subterranean ore deposit via the injection system.

More particularly, and as shown in FIG. 4, there is illustrated a subterranean uranium deposit 10 penetrated by spaced injection and production wells 12 and 14, respectively. Lixiviant is transferred from a blending system 15 of any suitable design by means of a pump 16 to the injection well and then displaced into the deposit 10. In the system illustrated, the lixiviant comprises sodium hypochlorite as the oxidant and sodium carbonate and/or bicarbonate as the complexing agent. The lixiviant may be formulated by supplying makeup water from a suitable source (not shown) to the blending system via line 18. Sodium hydroxide, carbon dioxide, and chlorine gas are also supplied to the blending system via lines 20, 21, and 22, respectively. The sodium hydroxide and chlorine react to produce sodium hypochlorite as described previously and the sodium hydroxide and carbon dioxide react to produce bicarbonate or carbonate ion, depending upon the pH of the lixiviant. At the higher pH's produced by adding relatively large amounts of sodium hydroxide, the complexing agent will be predominantly in the form of the carbonate ion. When lower amounts of sodium hydroxide are employed, bicarbonate will predominate.

At the production well, the pregnant lixiviant is produced to the surface by either downhole or uphole pumping means (not shown) and transferred to a heat exchanger 24 where it is heated to a temperature which normally will be in excess of 100° C. Preferably, the pregnant lixiviant will be heated to a temperature within the range of 150°–250° C. The heated lixiviant is transferred from the heat exchanger to a precipitation zone 25 where it is reduced from the hexavalent state to the tetravalent state. Reduction may be accomplished by treating the pregnant lixiviant with hydrogen under a pressure within the range of 10 to 50 atm in the presence of a suitable catalyst such as nickel, platinum, or freshly precipitated uranium dioxide. For a more detailed description of a suitable hydrogen reduction operation, reference is made to the aforementioned publication by Merritt, pages 235–237. Yellowcake ($UO_2$) is recovered from the precipitation zone via effluent line 26 and the now barren lixiviant is recirculated to the blending system 15. A small fraction of the barren lixiviant may be discarded to waste disposal and, if desired, the barren lixiviant may be passed to a desalinization unit before it is circulated to the blending system. The heated lixiviant is recharged with carbonate and hypochlorite as described prebiously and then reintroduced into the production well.

We claim:

1. In the recovery of uranium from a subterranean deposit containing uranium associated with carbonaceous material and penetrated by injection and production systems, the method comprising:

(a) introducing into said deposit via said injection system an aqueous alkaline lixiviant which solubilizes uranium in said deposit, said lixiviant having a pH within the range of 7.5 to 10.0 and containing an alkali metal or alkaline earth metal hypochlorite in a concentration of at least 0.01 weight percent, (b) displacing said lixiviant through said subterranean deposit to solubilize uranium therein, (c) producing pregnant lixiviant containing uranium from said production system, and (d) treating said pregnant lixiviant to recover uranium therefrom.

2. The method of claim 1 wherein said hypochlorite is present in a concentration within the range of 0.1–1.0 weight percent.

3. The method of claim 1 wherein said lixiviant has a pH within the range of 8–10.

4. The method of claim 1 wherein an alkali metal hydroxide and chlorine are added to said lixiviant to form said hypochlorite therein.

5. The method of claim 1 wherein said lixiviant contains an alkali metal carbonate or bicarbonate.

6. The method of claim 5 wherein an alkali metal hydroxide, chlorine, and carbon dioxide are added to said lixiviant to form said hypochlorite and said carbonate or bicarbonate therein.

7. The method of claim 1 wherein said lixiviant contains an alkali metal carbonate or bicarbonate, wherein said lixiviant has a pH within the range of 8 to 10, and wherein said hypochlorite is present in a concentration within the range of 0.1 to 1.0.

* * * * *